US009540904B2

(12) United States Patent
Petrowsky

(10) Patent No.: US 9,540,904 B2
(45) Date of Patent: Jan. 10, 2017

(54) COMBINATION BURST-DISC SUBASSEMBLY FOR HORIZONTAL AND VERTICAL WELL COMPLETIONS

(76) Inventor: Conrad Petrowsky, Red Deer (CA)

( * ) Notice: Subject to any disclaimer, the term of this patent is extended or adjusted under 35 U.S.C. 154(b) by 315 days.

(21) Appl. No.: 13/336,661

(22) Filed: Dec. 23, 2011

(65) Prior Publication Data

US 2013/0161028 A1 Jun. 27, 2013

(51) Int. Cl.
*E21B 33/12* (2006.01)
*E21B 34/06* (2006.01)

(52) U.S. Cl.
CPC ..... *E21B 34/063* (2013.01); *E21B 33/12* (2013.01)

(58) Field of Classification Search
CPC ..... E21B 34/103; E21B 33/12; E21B 34/063
USPC ..... 166/376, 386, 192, 317
See application file for complete search history.

(56) References Cited

U.S. PATENT DOCUMENTS

| | | | | |
|---|---|---|---|---|
| 2,616,502 | A * | 11/1952 | Lenz | 166/193 |
| 5,526,878 | A | 6/1996 | Duell et al. | |
| 5,924,696 | A | 7/1999 | Frazier | |
| 6,834,722 | B2 * | 12/2004 | Vacik et al. | 166/321 |
| 7,806,189 | B2 * | 10/2010 | Frazier | 166/376 |
| 2006/0124315 | A1 * | 6/2006 | Frazier et al. | 166/369 |

* cited by examiner

*Primary Examiner* — Nicole Coy
(74) *Attorney, Agent, or Firm* — Bennett Jones LLP

(57) ABSTRACT

A combination profile and burst-disc subassembly is provided for use in directional, horizontal or deviated or vertical wells during snubbing, bridge plug retrieval or zone separation operations in combination with packers and/or completion strings; the sub provides an plug for non-vertical situations which can be opened without wireline, while providing a landing for a wireline plug which may be required for vertical well sections during related operations.

2 Claims, 1 Drawing Sheet

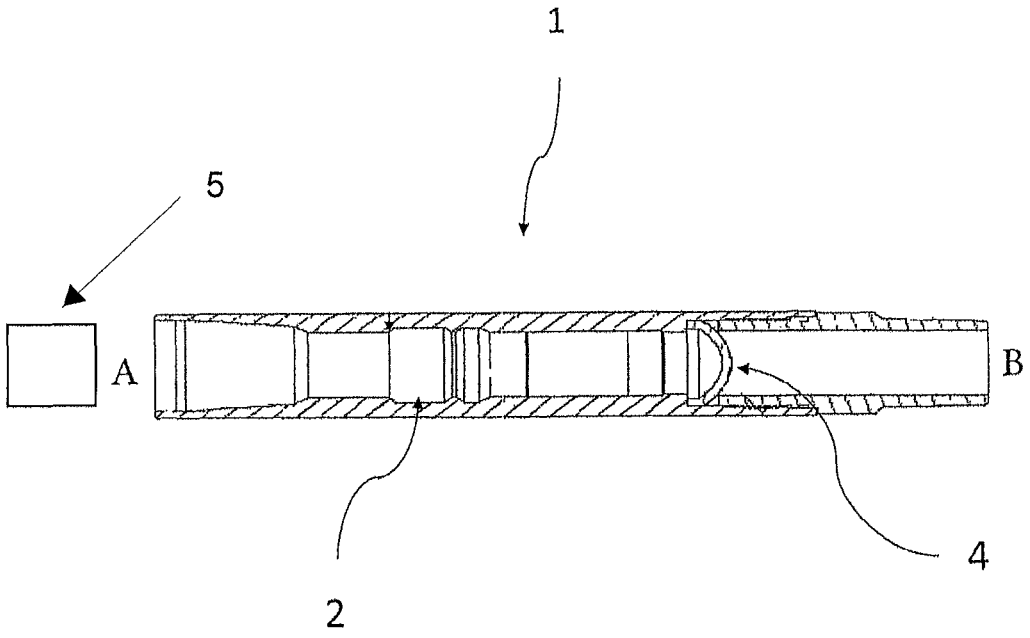
1
5
A
B
2
4

COMBINATION BURST-DISC SUBASSEMBLY FOR HORIZONTAL AND VERTICAL WELL COMPLETIONS

FIELD OF THE INVENTION

The present invention relates generally to a subassembly for a completion/drilling string use in directional, horizontal, deviated or vertical wells during snubbing, bridge plug retrieval or zone separation operations in combination with packers and/or completion strings; the sub provides a plug for non-vertical situations which can be opened without wireline, while providing a landing for a wireline plug which may be required for vertical well sections during related operations.

BACKGROUND OF THE INVENTION

In drilling, completion or service operations in a deviated well, it is sometimes important to be able to seal the tubing string mid-way to isolate production or other pressurized zones of the wellbore from surface.

In the past, tubing end-plugs have been used during injection of tubing into such a well, the plugs generally being a metallic or aluminum disc attached to the bottom of the tubing string prior to injection, and then the destruction of the metallic disc when the tubing string is located at bottom hole. This has the undesirable effect of leaving metal fragments at the bottom workface of the wellbore which is difficult or expensive to remove. These devices have only been run at the bottom of a tubing string, and cannot provide for dual sealing for tripping out of the wellbore.

Another mechanism sometimes seen is the use of an Otis® nipple, consisting of multiple profiles to receive a variety of plug devices via wireline delivery downhole. These mechanisms provide for a single plug, and while unpluggable and repluggable, are constrained by the plug delivery mechanism—that is, wireline plugs may be difficult to retrieve from deep deviated or horizontal wellbores, and may be impossible to inject and refit in non-vertical orientations. Additionally, if such a plug fitting fails during injection, the wireline plug may become a projectile, and two wireline plugs cannot or cannot easily be installed for the injection operations. Similarly, multi-profile landing nipples to receive a variety of plugs are manufactured under the Baker® trade name.

Frangible pressure seals such as disclosed in U.S. Pat. No. 5,924,696 are also known, but have not been deployed providing dual barriers during injection, nor do these devices themselves provide plug fittings, and have required the use of additional nipples or landings.

Thus, there is a need for a device to overcome the limitations of the prior art, in particular for use in deviated or non-vertical or horizontal wellbore situations.

SUMMARY OF THE INVENTION

To mitigate some of the problems with the prior art, this system provides for in a first aspect, a subassembly 1 with at least two pressure sealing mechanisms, comprising (i) a burst disc 4 and (ii) a fitting 2 for a profile plug 5. In a second aspect, the invention provides a method of sealing a tubing string during injection into a wellbore by providing a subassembly 1 within the tubing string (not shown) sealed by an intact burst disc 4. In a further embodiment, the invention provides that method where the tubing string is also sealed with a profile plug 5 seated, and sealed into a plug receiving profile fitting 2. In another embodiment, the invention provides a method of unsealing a tubing string after installation into a wellbore comprising bursting a burst disc 4 within a combination burst disc—profile fitting subassembly 1 by injection of fluid under pressure higher than the burst pressure of the burst disc, and then resealing the tubing string for removal or other operational reasons by landing and seating and sealing a profile plug into the included profile fitting 2 in the subassembly 1 attached to the tubing.

BRIEF DESCRIPTION OF THE DRAWINGS

Embodiments of the present invention will now be described, by way of example only, with reference to the attached FIGURE, wherein:

FIG. 1 is a longitudinal cross-section of an exemplary subassembly of the invention with an intact burst-disc installed, lower end toward the pin-end B of the FIGURE, showing a generic profile plug 5.

DETAILED DESCRIPTION

Generally, the present invention provides a subassembly 1 with at least two pressure sealing mechanisms, comprising (i) a burst disc 4 and (ii) a fitting 2 for a profile plug 5, the fitting comprising a recess. The burst disc 4 is generally deployed below the profile plug fitting 2 when the subassembly 1 is used, and the inner passage of the subassembly 1 when sealed by either an intact burst disc 4 or a plug 5 in the profile plug fitting 2 or both, does not permit fluid flow from tubing attached below the subassembly 1 through the subassembly 1 to tubing or the wellbore above the subassembly (or packing between the wellbore and the tubing, wherever located).

The burst disc 4, most typically made of breakable ceramic or similar substance, is designed to be breakable/broken by exertion of force from above the disc 4, such as by increasing fluid pressure within the conduit of attached wellbore tubing above the subassembly 1, while remaining unbroken/unbreakable by pressure exerted on the burst disc 4 from below the disk. Thus, the tubing string into which the subassembly 1 is assembled (not shown, but connected to the tubing string of the well at the upper end A and at the lower end B, above and below the subassembly 1, respectfully) can be sealed by the burst disc 4 when it is intact or opened when the burst disc 4 is broken. The burst disc 4 may be broken by exertion of increased pressure from uphole equipment, and the tubing below the subassembly can later be resealed by use of a profile plug 5 in the profile plug fitting 2 by wireline. If a plug 5 is fitted at the plug fitting 2 and if the burst disc 4 is unbroken, the subassembly provides a redundant double plug to the tubing string, enhancing reliability and safety.

This selective sealing functionality provides new and non-obvious utility to drilling, completion and other operations, in particular in situations where the lower portion of the wellbore is deviated, non-vertical, or horizontal making the use of wireline plugs impractical. The unitization of the two sealing mechanisms provides a subassembly of short length which does not require additional assembly steps while making or breaking the tubing string.

The subassembly can be deployed for injecting or removing tubing into a wellbore, in particular a well-bore having a vertical part from surface downward and a connected deviated or horizontal or non-vertical part below the vertical part of the wellbore. This way, the tubing can be sealed from formation pressures by the burst disc 4 during injection of the tubing into the well, and so the burst disc 4 can be in place at a point in the non-vertical part of the wellbore until the bottom end of the tubing string is placed were desired by the operator, at which stage the burst disc 4 can be broken by application of pressure down the tubing's inner conduit, thus opening the tubing's bottom end. In that setting, wireline plugs cannot be deployed because gravity alone will not provide sufficient force to inject the plug 5 into the tubing beyond a certain point of travel in a non-vertical direction due to frictional forces between the tubing's outside walls and the wellbore, among other forces. For similar reasons a wireline removal of a plug from a profile fitting in a non-vertical orientation may be difficult or impossible. In an embodiment, the subassembly 1 will be placed at a point on the tubing string such that when the tubing string is placed where the operator wants it, the subassembly is at or above the point where the wellbore changes from vertical to non-vertical directions, although placement of the subassembly will depend upon where the tubing needs to be sealed during removal, which may be dependent upon a number of factors such as tubing length and size, location of packers, location of production zones, location of perforations, pressures and other down hole conditions.

When removing tubing from such a wellbore, a standard wireline-deployed plug may be set at or near the bottom of the vertical part of the wellbore, and the tubing removed. When the subassembly 1 reaches the bottom of the substantially vertical part of the wellbore, it will be capable of receiving a wireline deployed profile plug 5 to mechanically seat and seal within the profile fitting 2 of the subassembly 1, and thus seal the tubing during its trip out of the wellbore to surface.

The subassembly 1 can be run into the wellbore with the burst disc 4 and a profile plug 5 seated and sealed to the profile plug fitting 2 to create a dual barrier. Even though the burst disc 4 could be in position above the plug profile fitting 2 it is more advantageous in operation to place the burst disc 4 below.

A shaved or slim-hole or special combination burst disc subassembly 1 with smaller diameter, for example 2⅞" O.D. may be used, such that two small diameter tools or strings can be worked through a 4½" liner or wellbore, while standard (non-shaved or slim-hole) 2⅞" O.D. assemblies could not.

It will be apparent to those knowledgeable about drilling, completion, workover and snubbing operations in the oilfield that the use of this invention can be applicable to other oilfield situations, and yet retains its novelty.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A method for unsealing a tubing string after installation into a wellbore comprising bursting a burst disc within a combination burst disc-profile fitting subassembly which has an included profile fitting uphole of the burst disc, by injection of fluid under pressure higher than the burst pressure of the burst disc; and then resealing the tubing string for removal or other operational reasons by landing and seating and sealing a profile plug supplied from surface into the included profile fitting in the subassembly attached to the tubing, the tubing string being first sealed with an intact burst disc, and also sealed with a plug seated and sealed into the included profile fitting where the plug is removed and the tubing string is sealed with an intact burst disc alone.

2. The method of claim 1 where, after the burst disc is burst the tubing string is later resealed with a plug seated into the included profile fitting alone.

* * * * *